US006221504B1

(12) United States Patent
Pfeffinger et al.

(10) Patent No.: US 6,221,504 B1
(45) Date of Patent: Apr. 24, 2001

(54) COATING CONSISTING OF HYPEREUTECTIC ALUMINUM/SILICON ALLOY AND/OR AN ALUMINUM/SILICON COMPOSITE MATERIAL

(75) Inventors: Harald Pfeffinger, Tiefenbronn; Micheal Voit, Remseck; Tilman Haug, Uhldingen-Muehlhof; Patrick Izquierdo; Herbert Gasthuber, both of Ulm; Oliver Storz, Blaustein; Axel Heuberger, Wildberg; Franz Rueckert, Ostfildern; Peter Stocker, Sulzbach; Helmut Proefrock, Leutenbach, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/127,794

(22) Filed: Aug. 3, 1998

(30) Foreign Application Priority Data

Aug. 1, 1997 (DE) ..... 197 33 204

(51) Int. Cl.[7] ..... C23C 4/04

(52) U.S. Cl. ..... 428/564; 428/558; 428/559; 428/650; 428/653

(58) Field of Search ..... 428/564, 558, 428/650, 546, 559, 570, 653

(56) References Cited

U.S. PATENT DOCUMENTS

| | | | |
|---|---|---|---|
| 3,991,240 | | 11/1976 | Harrington et al. . |
| 4,661,682 | | 4/1987 | Gruner et al. . |
| 4,707,379 | | 11/1987 | Neufuss et al. . |
| 5,080,056 | | 1/1992 | Kramer et al. . |
| 5,271,967 | | 12/1993 | Kramer et al. . |
| 5,303,682 | * | 4/1994 | Donahue et al. . |
| 5,442,153 | | 8/1995 | Marantz et al. . |

FOREIGN PATENT DOCUMENTS

| | | | |
|---|---|---|---|
| 39 41 381 A1 | | 6/1991 | (DE) . |
| 43 28 619 C2 | | 3/1995 | (DE) . |
| 195 08 687 C2 | | 10/1995 | (DE) . |
| 44 34 576 A1 | | 2/1996 | (DE) . |
| 44 38 550 A1 | | 5/1996 | (DE) . |
| 197 33 205 | * | 2/1999 | (DE) . |
| 0 411 577 B1 | | 2/1991 | (EP) . |
| 0 526 079 B1 | | 2/1993 | (EP) . |

(List continued on next page.)

OTHER PUBLICATIONS

Patent Abstracts of Japan, 56166368, Dec. 21, 1981, Kato Shinji.

Patent Abstracts of Japan, 59219468, Dec. 10, 1984, Shimizu Yoichi.

Patent Abstracts of Japan, 06330274, Nov. 29, 1994, Fujinaga Minoru.

(List continued on next page.)

*Primary Examiner*—Deborah Jones
*Assistant Examiner*—Jason Savage
(74) *Attorney, Agent, or Firm*—Evenson, McKeown, Edwards & Lenahan, P.L.L.C.

(57) ABSTRACT

A tribological coating made of a copper-free highly hypereutectic aluminum/silicon alloy and/or of a copper-free aluminum/silicon composite material composed such that fine silicon primary crystals and/or silicon particles, intermetallic phases, and oxides form as hard particles during the production of the layers in the atmospheric thermal spraying method and/or are anchored in the structure. The surface of the coating can be machined economically by short-chipping using conventional tools, so that additional alloy elements such as copper for forming additional intermetallic phases such as $Al_2Cu$ can be eliminated. This is significant because conventional AlSi cylinder liners in reciprocating engines pose problems in conjunction with certain fuels because of their copper content.

10 Claims, 1 Drawing Sheet

FOREIGN PATENT DOCUMENTS

| | | |
|---|---|---|
| 0 585 203 A1 | 3/1994 | (EP) . |
| 0 607 779 A1 | 7/1994 | (EP) . |
| 8-225915 | 9/1996 | (JP) . |
| WO 90/12899 | 11/1990 | (WO) . |
| WO 97/13884 | 4/1997 | (WO) . |

OTHER PUBLICATIONS

Patent Abstracts of Japan, 58064371, Apr. 16, 1983, Kaneko Toshiki.
Patent Abstracts of Japan, 05305492, Nov. 19, 1993, Shioda Shunta.

* cited by examiner

COATING CONSISTING OF HYPEREUTECTIC ALUMINUM/SILICON ALLOY AND/OR AN ALUMINUM/SILICON COMPOSITE MATERIAL

BACKGROUND AND SUMMARY OF THE INVENTION

This application claims the priority of German Patent Application No. 197 33 204.8, filed Aug. 1, 1997, the disclosure of which is expressly incorporated by reference herein.

The present invention relates to a coating composed of a hypereutectic aluminum/silicon alloy and/or an aluminum/silicon composite material for manufacturing wear-resistant, low-friction layers as well as a method for manufacturing the coating, both of which are used in industry.

In automobile construction, at the present time, most of the gray cast iron crankcases of reciprocating engines that are dominant today (their share in 1994 in Germany was still a dominant 96% and 8 2% Europe-wide) are gradually being displaced by those made of lightweight metals in order to reduce the total weight of the vehicle and hence to improve fuel consumption. Diecasting of low-alloyed aluminum such as AlSi10 for manufacturing crankcases from lightweight metal will initially qualify for economic and technical reasons. However, such alloys, in contrast to the atmospheric casting of hypereutectic aluminum-silicon alloys such as ALUSIL™ (AlSi17) that have become established in engine-building but are much more expensive, exhibit unsatisfactory behavior regarding abrasion and wear when in contact with aluminum pistons and piston rings, and are therefore unsuitable as friction partners.

Therefore, the casting of tribologically suitable liners made of gray cast iron or hypereutectic aluminum-silicon cannot be eliminated in making future engines. To manufacture these liners in accordance with DE 43 28 619 C2 or DE 44 38 550 A1 for example, blanks are manufactured by the known Ospray method and then compacted mechanically. The semi-finished liner is placed in the mold before casting and then has molten aluminum cast around it. The typical wall thickness of such liners is 2 to 3 mm. Then the interior of the liner is coarse- and fine-turned, honed, and exposed. The alloys used contain copper so that, in particular, intermetallic phases such as $Al_2Cu$ are formed that are required for short-chipping machining of the layer surface. The use of these alloys containing copper poses particular problems in conjunction with certain fuels.

The spray-compacted blocks according to DE 43 28 619 C2 and EP 0 411 577 B1 are manufactured with copper-free aluminum/silicon alloys, but have not been used heretofore as cylinder liners because the surface of the cylinder liners cannot be machined by short-chipping and therefore do not constitute an economically feasible alternative.

Moreover, this liner solution involves disadvantages relating to design, manufacturing technology, and economics, such as limited adhesion of the AlSi10 melt to the liner surface, costly handling, and high price. In addition, the wall thickness of the liners influences the minimum cylinder spacing. The wall width, especially in future engines with a small size, should be as small as possible because it helps determine the minimum external dimensions of the engine.

Thermal spraying offers further opportunities to apply wear-resistant coatings to cylinders in crankcases. The basic principle of thermal spraying consists in a meltable or partially meltable material being melted in a high-speed hot gas stream to form small spray droplets and then being accelerated toward the surface to be coated (DIN 32530). Upon impact, the sprayed droplets solidify when they strike the relatively cold metal surface and form layer upon layer to create a coating. The advantage of this coating technique over electrodeposition, chemical or physical gas phase deposition, and the like is the high application rate that makes it possible to coat a cylinder economically in a few minutes. The methods of thermal spraying differ in terms of the way they are performed and in the properties of the high-speed speed hot gas stream.

In high-speed flame-spraying (HVOF), an acetylene-oxygen flame is produced in which the spray particles are accelerated to supersonic speed and are deformed when they impact the surface to be coated. The HVOF method has been used with an aluminum-bronze alloy (U.S. Pat. No. 5,080,056) and an iron-aluminum composite material (EP 0 607 779 A1), but produces excessive heat which frequently can be carried away only by expensive additional cooling of the crankcase (U.S. Pat. No. 5,271,967).

In plasma spraying, gases such as argon, helium, nitrogen, and/or hydrogen are fed through an electric arc in a plasma state in which the powdered (EP 0 585 203 A1 and U.S. Pat. No. 4,661,682) or wire-form (U.S. Pat. No. 5,442,153) spraying material is added laterally in order to be deflected there, moderately accelerated by comparison with HVOF, and melted. In this case the spray particles are heated to a higher temperature than in HVOF, so that they are in a molten state when they impact the substrate, which ensures an intimate material connection of the layer to the substrate. Powder plasma spraying has already been used for coating cylinder bores with a layer on an iron base (U.S. Pat. No. 3,991,240). Wire plasma spraying has been used for coating cylinder bores with an AISI 1045 steel (DE 195 08 687). Efforts to replace cylinder linings made of gray cast iron by those made of hypereutectic aluminum/silicon, however, indicate that an iron-based cylinder liner cannot meet the technical and tribological requirements of modern reciprocating engines.

The goal of the present invention is to develop a thermally sprayed, wear-resistant layer especially for building engines in terms of wear-resistance and lubricating oil consumption, and at the same time to reduce the danger of wear for components in contact with one another.

By using special, essentially copper-free aluminum/silicon spray powders for applying the coating according to the present invention by means of atmospheric thermal spraying methods, a heterogeneous layered structure made of aluminum mixed crystals, silicon precipitates and particles, intermetallic phases such as $Mg_2Si$, and extremely finely divided oxides is produced during the layered formation of the coating. The formation and distribution of the oxides are attributed exclusively to the nonequilibrium properties of the atmospheric thermal spraying method. Surprisingly, the layer surface of a coating according to the present invention can be machined economically by short-chipping despite the absence of copper, which may be due to the finely divided oxides on the surface of the coating and preferably also inside the coating. In addition, the coating exhibits improved wear resistance.

To produce aluminum/silicon layers that can be machined by short-chipping and are essentially copper-free by means of atmospheric thermal spraying, atmospheric plasma spraying is preferred because of the good melting properties of the spray particles and the formation of finely divided oxides with good adhesion to the substrate and moderate heat transfer to the part. Moreover, this method offers the possibility of producing custom coatings so that preturning can be eliminated from the surface machining of the layer.

For economic and technical reasons, a coating is advantageous that ensures good machinability of its surface, especially by short-chipping. In order for this wear-resistant coating, machinable by short-chipping, to be usable for coating crankcases, in addition to reducing combustion residues by lowering lubricating oil consumption, it is desirable to use it for all types of fuels worldwide, for which reason the coating is copper-free, especially when used for the cylinder liners of internal combustion engines.

It is also advantageous that with the wear-resistant aluminum/silicon coating according to the present invention, following a diecasting process, for example, a cylinder liner in a diecast engine block made of lightweight metal such as aluminum or magnesium, the coating may be applied by a thermal spraying method, so that the previously conventional but expensive liner solution can be eliminated. In addition, the thickness of the actual tribological contact surface on the crankcase, which is not satisfactory from the tribological standpoint but is easy to cast and machine, can be reduced considerably. For example, the 0.1 to 0.2 mm thickness of the present invention is less than 1/10 of the lining wall thickness in conventional use today and therefore offers the possibility of building engines that are much more compact.

Advantageously, plasma spraying is used to produce the coating. With this nonequilibrium method, structures can be formed that otherwise cannot be created metallurgically. Because of the high energy density and the large number of parameters in the method, oxides can be formed in the layer structure almost by definition, contributing to short-chipping machinability of the layer surface and making an important contribution to the wear resistance of the layers. By using agglomerated spraying powders, any foreign material can also be added to the layer, even those with melting points significantly different from that of the aluminum alloy, such as hard metal or ceramic particles or even dry lubricants.

Advantageously, the coating according to the present invention can be integrated unchanged into the manufacturing equipment installed today and used for mass production, so that the expensive manufacture and handling of the cylinder linings is eliminated and considerable amounts of material can be saved. With the method according to the present invention, the coating process can take place at high application rates with especially short cycle times, with the coating being applied in a very closely fitting manner to the cylinder wall of the crankcase and a fine surface quality thus being achieved. These measures eliminate costly finishing machining steps such as preturning for example, and possibly even fine turning can be eliminated, thus significantly reducing manufacturing costs.

Other objects, advantages and novel features of the present invention will become apparent from the following detailed description of the invention when considered in conjunction with the accompanying drawings.

DETAILED DESCRIPTION OF THE DRAWINGS

In order to create the coatings shown in the figures, spray powder was developed that was made of copper-free aluminum/aluminum alloys and/or aluminum/silicon composite materials. Following optimization of the composition, emphasis was placed on the shape of the individual spray powder particles in the spray powders, the powder grain distribution, and the flow behavior of the spray powder.

For example, two essentially copper-free aluminum/silicon alloy systems were chosen as spray powders, with an alloy A (see FIG. 1) being used in conjunction with iron-coated pistons in particular and an alloy A (see FIG. 2) being used preferably for uncoated pistons.

Examples of possible alloys are given in the following examples, with the numerical data expressing the content in weight percent:

EXAMPLE 1

Alloy A:

Silicon, 23.0 to 40.0%, preferably approximately 25%;

magnesium, 0.8 to 2.0%, preferably approximately 1.2%;

zirconium, maximum 0.6%;

iron, maximum 0.25%;

manganese, nickel, copper, and zinc, maximum of 0.01% each;

and remainder aluminum.

EXAMPLE 2

Alloy B differs from alloy A only in the slightly higher iron and nickel content.

silicon, 23.0 to 40.0%, preferably approximately 25%;

nickel, 1.0 to 5.0%, preferably approximately 4%;

iron, 1.0 to 1.4%, preferably approximately 1.2%;

magnesium, 0.8 to 2.0%, preferably approximately 1.2%;

zirconium, maximum 0.6%;

manganese, copper, and zinc, maximum of 0.01% each; and remainder aluminum.

EXAMPLE 3

Alloy C:

silicon, 0 to 11.8%, preferably approximately 9%;

magnesium, 0.8 to 2.0%, preferably approximately 1.2%;

zirconium, maximum 0.6%;

iron, maximum 0.25%;

manganese, nickel, copper, and zinc, maximum of 0.01% each;

and remainder aluminum.

EXAMPLE 4

Alloy D:

silicon, 0 to 11.8%, preferably approximately 9%;

nickel, 1.0 to 5.0%, preferably approximately 4%;

iron, 1.0 to 1.4%, preferably approximately 1.2%;

magnesium, 0.8 to 2.0%, preferably approximately 1.2%;

zirconium, maximum 0.6%;

manganese, copper, and zinc, maximum of 0.01% each; and remainder aluminum.

EXAMPLE 5

Alloy E:

silicon, 11.8 to 40.0%, preferably approximately 17%;

magnesium, 0.8 to 2.0%, preferably approximately 1.2%;

zirconium, maximum 0.6%;

iron, maximum 0.25%;

manganese, nickel, copper, and zinc, maximum of 0.01% each;

and remainder aluminum.

EXAMPLE 6

Alloy F:

silicon, 11.8 to 40%, preferably approximately 17%;

nickel, 1.0 to 5.0%, preferably approximately 4%;

iron, 1.0 to 1.4preferably approximately 1.2%;

magnesium, 0.8 to 2.0%, preferably approximately 1.2%;

zirconium, maximum 0.6%;

manganese, copper, and zinc, maximum of 0.01% each; and remainder aluminum.

Figure 1:
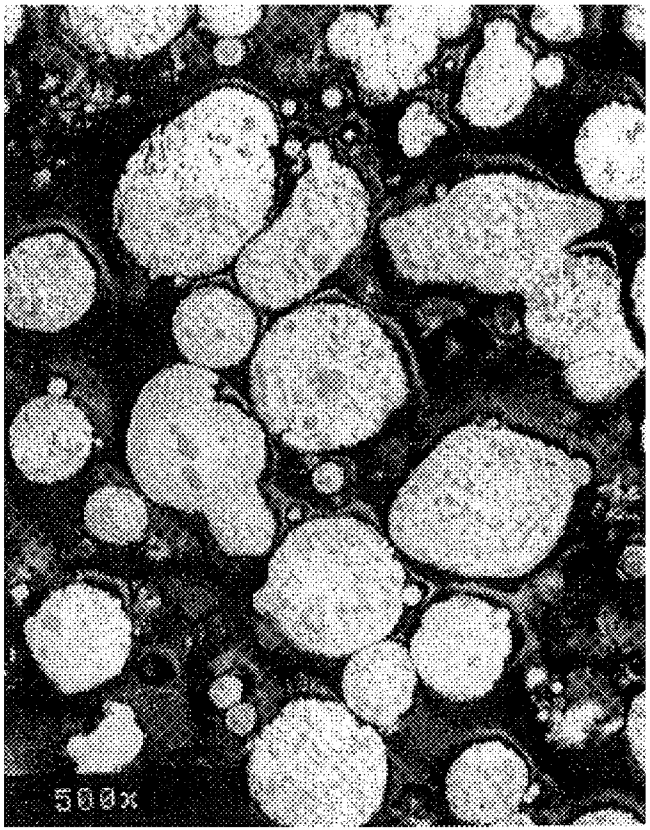
FIG. 1 shows a polished section of the spherical spray particles from alloy A.

FIG. 1 shows a polished section of the spherical spray particles in alloy A, in which the aluminum mixed-crystal structure and the Si primary precipitates are clearly visible. The section was etched in order to attack the aluminum mixed crystal and thus show the structure more clearly. In addition to the silicon primary precipitates, the structure consists of primary aluminum mixed crystal dendrites in which the dendrite arms are sheathed by eutectic silicon. The size of the dendrite arms varies considerably, so that they can be dissolved only conditionally. The variations in the fineness of the existing structure are due to the variations in temperature and speed of individual metal drops and also from the difference in seed formation during the hardening of different melt drops. Such a fine structure characterizes thermally sprayed layers in contrast to structures produced by a powder-metallic route and is responsible for the good wear resistance of these layers.

Figure 2:
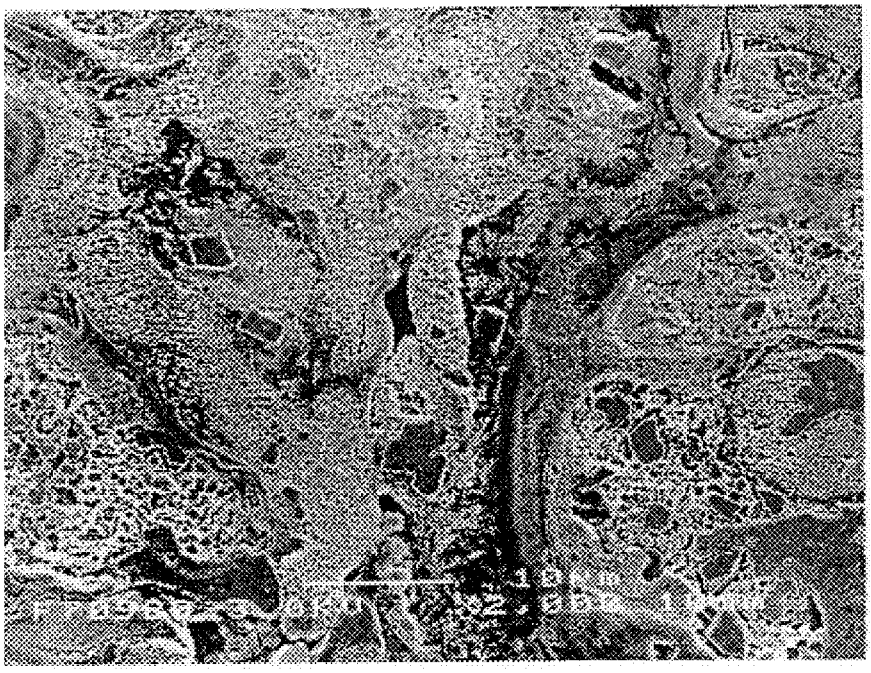
FIG. 2 is a scanning electron photomicrograph of a plasma-sprayed coating.

In FIG. 2, a scanning electron photomicrograph of a plasma-sprayed layer is shown that was produced with the spray powder in alloy A. The layer produced with the spray powder of alloy A was honed and exposed mechanically. During the production of the layer, close dimensional tolerances were maintained so that preturning and fine turning could be eliminated. In addition to the homogenous distribution of the silicon primary precipitates, intermetallic phases and pores can also be seen which retain small amounts of oil during operation and help in the formation of a thin oil film on the surface of the cylinder liner.

Aluminum/silicon composite powders were developed to increase the percentage of coarse Si particles in the layer. The agglomerated composite powders consist of fine silicon particles and fine metallic particles of an aluminum/silicon alloy, bonded together by inorganic or organic binders, with the percentage of silicon particles being 5 to 50% and the percentage of alloy particles being 50 to 95%. The silicon particles have an average grain size of 0.1 to 10.0 $\mu$m, preferably approximately 5 $\mu$m. The metallic particles have an average particle size of 0.1 to 50.0 $\mu$m, preferably approximately 5 $\mu$m and consist of both alternatively usable hypoeutectic alloys C or D or of both alternatively usable hypereutectic alloys E or F. Using hypereutectic alloy particles preserves the percentage of aluminum mixed crystals in the layer structure, while the formation of aluminum mixed crystals in the layer structure is suppressed by using hypoeutectic aluminum/silicon particles.

The coating of a cylinder bore according to the present invention assumes that the lightweight metal block is cast in the usual fashion by diecasting methods but without placing cylinder liners in the mold. The cylinder bore in the crankcase is then preturned coarsely in one workstep in order to provide the necessary shape and position tolerances. Then the aluminum-silicon coating is applied. The coating process can either be performed in the mold, so that a suitable commercially available internal burner can be introduced into the bore that rotates around the central axis of the cylinder and is moved axially, or a nonrotating burner is introduced into the cylinder bore of the rotating crankcase and is guided along the central axis of the cylinder in order to spray the coating nearly at right angles to the cylinder wall. The latter is simpler from the methodology standpoint and is safer since the application of the required media such as electrical energy, cooling water, primary and secondary gases, and spray powder by a rotating assembly poses problems.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A wear-resistant aluminum-silicon coating, comprising:

a heterogeneous structure containing silicon primary precipitates having a size of less than 10 $\mu$m, aluminum mixed crystal, intermetallic phases, and oxides having an average size of less than 5 $\mu$m, and a copper content of under 0.1 wt.-%;

wherein the coating is made by thermal atmospheric plasma spraying of a spray powder.

2. A coating according to claim 1, wherein the coating comprises a hypereutectic aluminum-silicon alloy having a silicon content of over 20 wt.-%, and wherein the aluminum mixed crystal is in the form of primary aluminum mixed crystal dendrites having dendrite branches sheathed by eutectic silicon.

3. A coating according to claim 1, wherein the coating structure is a layer in which particles of at least one foreign material are embedded.

4. A coating according to claim 3, wherein the layer comprises a hypereutectic aluminum-silicon alloy containing the silicon primary precipitates and the primary aluminum mixed crystal dendrites having dendrite branches sheathed by eutectic silicon.

5. A coating according to claim 3, wherein the layer comprises a hypoeutectic aluminum-silicon alloy.

6. A coating according to claim 3, wherein the particles embedded in the layer structure are silicon particles.

7. A coating according to claim 6, wherein the silicon particles have a size of less than 10 $\mu$m.

8. A coating according to claim 1, wherein the intermetallic phases comprise $Mg_2Si$.

9. A cylinder liner of a reciprocating engine comprising a coating according to claim 1.

10. A cylinder liner according to claim 9, wherein the engine has a crankcase comprising a material selected from the group consisting of gray cast iron, iron, aluminum, and magnesium.

* * * * *